US006606466B2

(12) United States Patent
Sato

(10) Patent No.: US 6,606,466 B2
(45) Date of Patent: Aug. 12, 2003

(54) PRINT CONTROL APPARATUS INDICATING APPROPRIATE PAPER CASSETTE FOR PRINTING AND METHOD OF SAME

(75) Inventor: Nobuhiko Sato, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/939,584

(22) Filed: Aug. 28, 2001

(65) Prior Publication Data

US 2002/0024575 A1 Feb. 28, 2002

(30) Foreign Application Priority Data

Aug. 30, 2000 (JP) ..... 2000-260796

(51) Int. Cl.[7] ..... G03G 15/00

(52) U.S. Cl. ..... 399/82; 399/23; 399/45; 399/81

(58) Field of Search ..... 399/23, 45, 82, 399/86, 389, 84, 81

(56) References Cited

U.S. PATENT DOCUMENTS 4,804,997 A * 2/1989 Mizude et al. ..... 399/389
4,908,672 A * 3/1990 Ito ..... 399/82
5,130,757 A * 7/1992 Ito ..... 399/389 X
5,161,037 A * 11/1992 Saito ..... 399/84
5,168,316 A * 12/1992 Hino et al. ..... 399/23
5,995,779 A * 11/1999 Natsume et al. ..... 399/82
6,029,026 A * 2/2000 Natsume et al. ..... 399/82
6,048,115 A 4/2000 Unishi et al. ..... 400/74
6,125,242 A * 9/2000 Yamada ..... 399/23
6,285,843 B1 * 9/2001 Obata ..... 399/82

* cited by examiner

*Primary Examiner*—Fred L Braun
(74) *Attorney, Agent, or Firm*—Fitzpatrick, Cella, Harper & Scinto

(57) ABSTRACT

A printer and method for enabling a user to select a paper cassette containing paper available for an appropriate finishing process when the user is to select another paper cassette to continue printing, after the print process has been interrupted due to an empty paper cassette. The printer or method uses a table containing information about the types of paper mounted in respective paper cassettes and a table containing information about relationships between the paper types and the finishing processes executable on the respective types of paper. If no appropriate paper is detected in the current paper cassette, it is determined which paper cassette contains papers available for the specified paper finishing process, and then the appropriate paper cassette information is displayed.

32 Claims, 15 Drawing Sheets

FIG. 4

| | | FINISHING | | | | |
|---|---|---|---|---|---|---|
| | | STANDARD | FAIR COPY | STAPLING | PUNCHING | DUPLEX |
| PAPER SIZE | A4 | 1 | 1 | 1 | 1 | 1 |
| | A3 | 1 | 1 | 1 | 0 | 1 |
| PAPER TYPE | PLAIN | 1 | 1 | 1 | 1 | 1 |
| | REUSED | 1 | 0 | 1 | 1 | 0 |
| | OHP | 1 | 1 | 0 | 0 | 0 |
| | INTERMEDIATE | 1 | 1 | 0 | 1 | 0 |

FIG. 9

| CASSETTE | PAPER SIZE | PAPER TYPE |
|---|---|---|
| 1ST STAGE | A4 | PLAIN |
| 2ND STAGE | A3 | PLAIN |
| 3RD STAGE | A4 | REUSED |
| 4TH STAGE | A4 | OHP |
| 5TH STAGE | A4 | INTERMEDIATE |

NO CASSETTE WITH OPTIMUM PAPER.
PLEASE SELECT SUBSTITUTE CASSETTE.

| CASSETTE | PAPER SIZE | PAPER TYPE | AND | PUNCHING |
|---|---|---|---|---|
| 1ST STAGE | 11111 | 11111 | 11111 | 1 |
| 2ND STAGE | 11101 | 11111 | 11101 | 0 |
| 3RD STAGE | 11111 | 10110 | 10110 | 1 |
| 4TH STAGE | 11111 | 11000 | 11000 | 0 |
| 5TH STAGE | 11111 | 11010 | 11010 | 1 |

NO CASSETTE WITH OPTIMUM PAPER.
PLEASE SELECT SUBSTITUTE CASSETTE.

| CASSETTE | PAPER SIZE | PAPER TYPE | AND | PUNCHING | FAIR COPY | PUNCHING & FAIR COPY |
|---|---|---|---|---|---|---|
| 1ST STAGE | 11111 | 11111 | 11111 | 1 | 1 | 1 |
| 2ND STAGE | 11101 | 11111 | 11101 | 0 | 1 | 0 |
| 3RD STAGE | 11111 | 10110 | 10110 | 1 | 0 | 0 |
| 4TH STAGE | 11111 | 11000 | 11000 | 0 | 1 | 0 |
| 5TH STAGE | 11111 | 11010 | 11010 | 1 | 1 | 1 |

PRINT CONTROL APPARATUS INDICATING APPROPRIATE PAPER CASSETTE FOR PRINTING AND METHOD OF SAME

BACKGROUND OF THE INVENTION

1. Field of the Invention

The present invention relates to a printer or the like capable of printing with some process on a printed paper.

2. Related Background Art

Conventionally, this type of printer comprises a print unit for printing on a paper, a plurality of paper cassettes on which papers supplied to the print unit are mounted, a paper sensor for detecting that papers run out in the current paper cassette, a display unit for displaying information such as error information about an error which has occurred during printing or error recovery information, and an operation unit for a user to execute some operation on the basis of information displayed on a display unit.

It is also possible before printing to specify a finishing process on an image printed paper as well as specifying what image is printed. As the finishing process, there can be, for example, fair copy, stapling, punching, and duplex processes.

If the paper runs out in the paper cassette under a paper feed operation, other paper cassettes are displayed on the display unit to cause a user to select an appropriate paper cassette out of them, by which the user can continue the printing.

In the above conventional printer, however, when the user selects a paper cassette due to running out of the paper for printing, just other paper cassettes are displayed on the display unit and it is impossible to present any information about which paper cassette contains papers available for a planned finishing process. Therefore, there is a problem that the planned finishing process cannot be executed by selecting inappropriate papers.

SUMMARY OF THE INVENTION

In view of the above problem, it is an object of the present invention to provide a printer which enables a user to select a cassette containing papers available for an appropriate finishing process when selecting another paper cassette to continue the printing in a condition that the print process is interrupted by running out of papers in the current paper cassette.

According to one aspect, the present invention which achieves this object related to a print controller, comprising judgement means for judging a print mode specified by print data from an external apparatus, recording medium type storing means for storing what type of recording medium is mounted on each of the paper cassettes, paper cassette selecting means for causing a user to select a substitute paper cassette when detecting that the recording medium in the current paper cassette runs out in printing the print data, process executable/nonexecutable determination means for determining whether the predetermined process is executable on the recording medium mounted on each of the paper cassettes on the basis of the information obtained from the recording medium type storing means and the print mode judged by the judgement means, and control means for causing a user to select only the paper cassette determined to be executable by the process executable/nonexecutable determination means in the paper cassette selecting means.

According to another aspect, the present invention which achieves this object related to a print controller, comprising judgement means for judging a print mode specified by print data from an external apparatus, recording medium type storing means for storing what type of recording medium is mounted on each of the paper cassettes, paper cassette selecting means for displaying substitute paper cassettes to cause a user to select one of the paper cassettes when detecting that the recording medium runs in the current paper cassette runs out, process executable/nonexecutable determination means for determining whether the predetermined process is executable on the recording media mounted on each of the paper cassettes on the basis of the information obtained from the recording medium type storing means and the print mode judged by the judgement means, and display control means for displaying paper cassettes determined to be executable or nonexecutable by the process executable/nonexecutable determination means so as to be discriminated from each other on the paper cassette selecting means.

Other objects and features besides those discussed above shall be apparent to those skilled in the art from the description of preferred embodiments of the invention which follows and accompanying drawings.

BRIEF DESCRIPTION OF THE DRAWINGS

FIG. 4 is a diagram showing a content of a print mode table;

FIG. 9 is a diagram showing a content of a cassette information table;

DETAILED DESCRIPTION OF THE PREFERRED EMBODIMENTS

The preferred embodiments of the present invention will now be described in detail hereinafter with reference to the accompanying drawings.

First Embodiment

Figure 1:
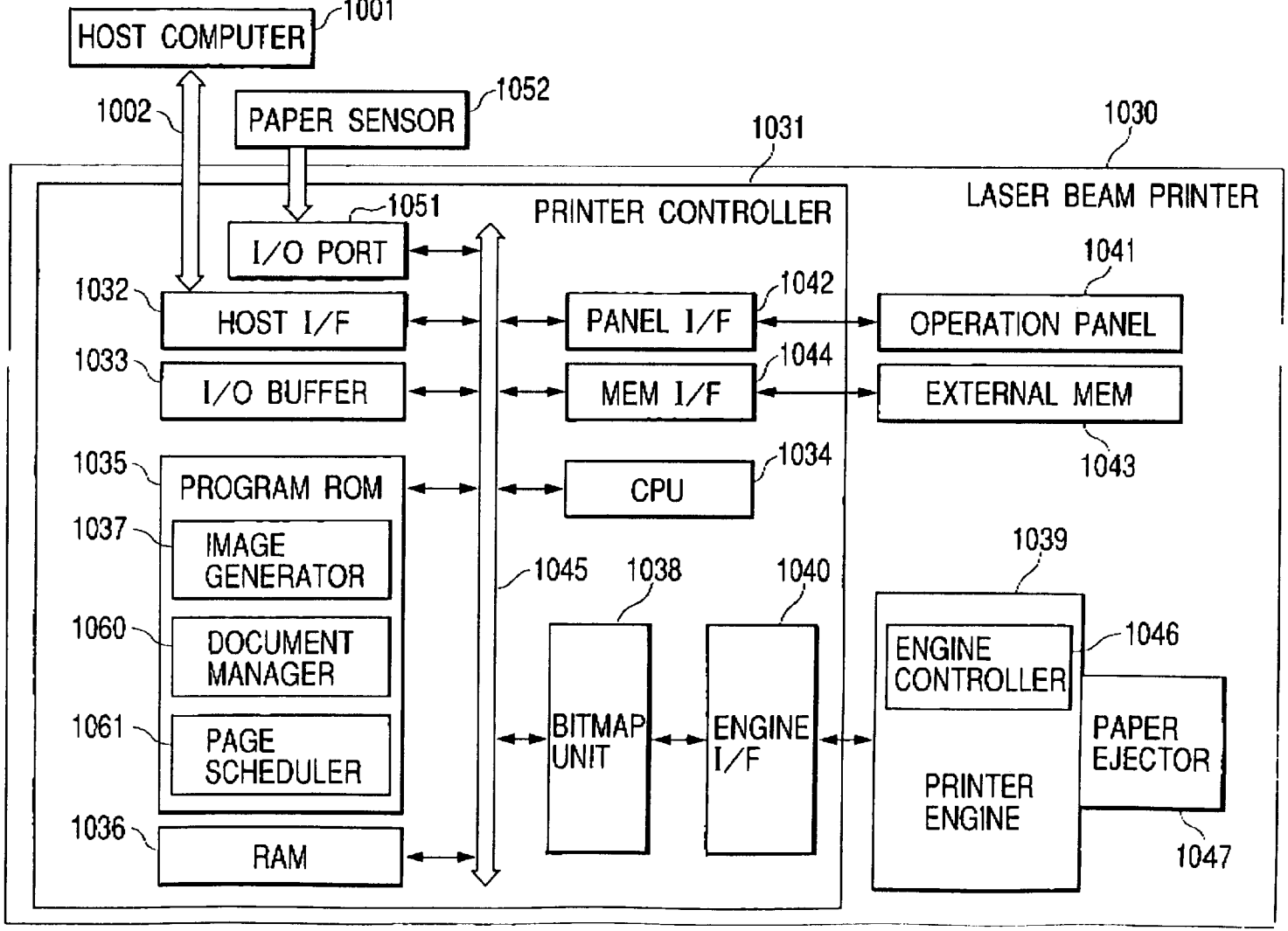
FIG. 1 is a block diagram showing a function configuration of a printer according to a first embodiment of the present invention.

Referring to FIG. 1, there is shown a block diagram showing a function configuration of a printer according to a first embodiment of the present invention.

This printer comprises a laser beam printer 1030, for example, and is connected to a host computer 1001 via a communication line 1002.

The laser beam printer 1030 incorporates a laser beam printer controller 1031 for controlling operations of the entire printer.

The printer controller 1031 comprises an I/O buffer 1033 for transmitting or receiving data from control codes or respective communication means via a host I/F 1032 for controlling inputs or outputs to or from the host computer 1001, a CPU 1034 for controlling the entire operations of the printer controller 1031, a program ROM 1035 containing programs for describing operations of the CPU 1034, a RAM 1036 used as a work memory for interpreting the control codes or data, a calculation necessary for printing, or processing of print data, a bit map unit 1038 for developing an image object into a bit map image and transferring the developed bit map image to a printer engine, an engine I/F 1040 for coupling the printer engine 1039 for actually printing data on paper to the printer controller 1031, an operation panel 1041 for operating the printer, a panel I/F 1042 for coupling the printer controller 1031 to the operation panel 1041, an external memory 1043 used for storing print data or various information of the printer, a memory I/F 1044 for coupling the printer controller 1031 to the external memory 1043, an I/O port 1051 connected to various sensors, and a system bus 1045 for coupling respective units.

In addition, the program ROM 1035 incorporates respective programs for an image generator 1037 for generating various image objects on the basis of data settings received from the host computer 1001, a document manager 1060 for managing print page or single-sided/duplex information of all documents including interrupting/interrupted documents, address management for objects, or other various information of print documents, and a page scheduler 1061 for determining a printing sequence for single-sided/duplex or interrupting/interrupted documents.

Output signals of the various sensors are read into the CPU 1034 via the I/O port 1051. The various sensors include a paper sensor 1052 for detecting whether printing papers remain in a paper cassette and a size detection mechanism for electrically detecting a size of the printing papers in the paper cassette, for example.

The printer engine 1039 has an engine controller 1046 for controlling print processes (for example, paper feed, etc.) of each mechanism of the engine, and the paper ejector 1047 is used for managing operations of the paper ejector connected to the printer body.

Figure 2:
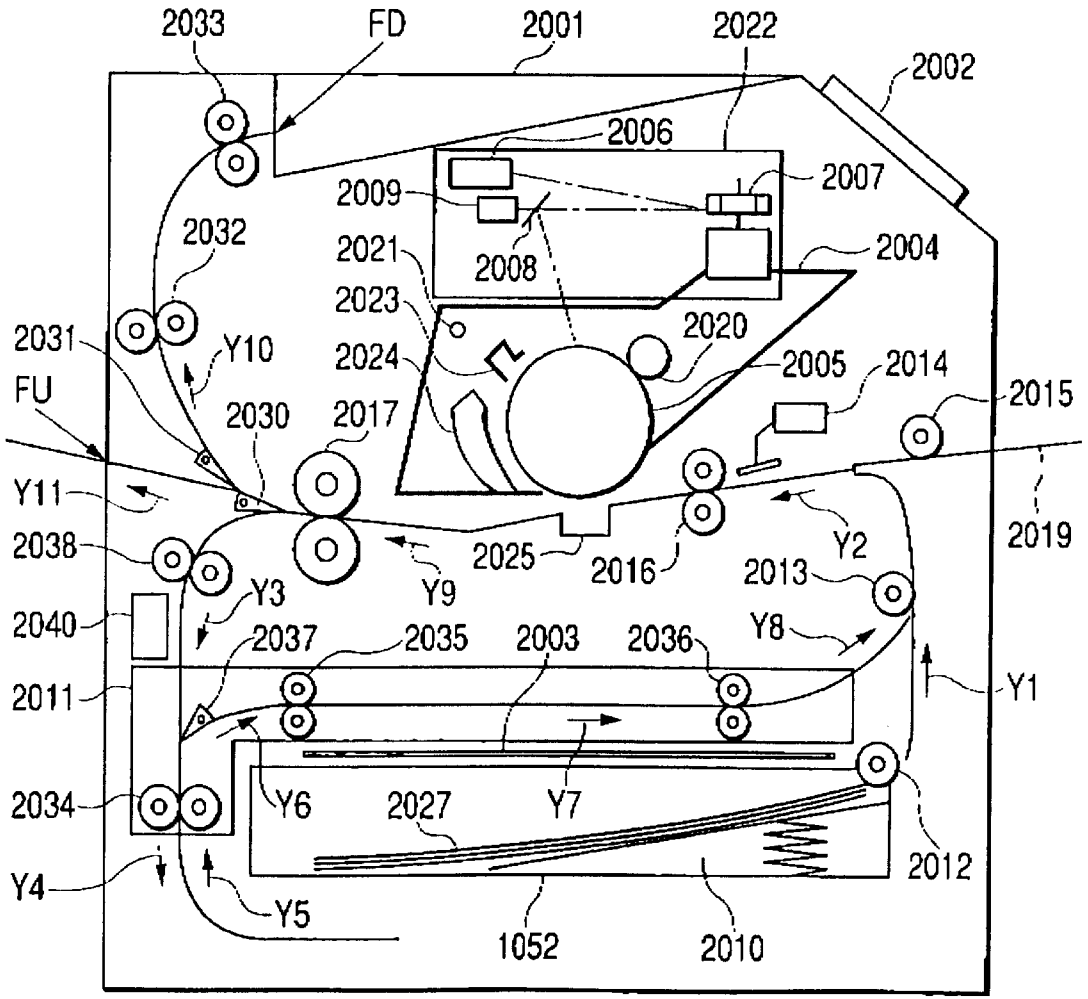
FIG. 2 is a schematic cross section showing a configuration of an engine unit of a laser beam printer.

Referring to FIG. 2, there is shown a schematic cross section indicating a configuration of the above laser beam printer engine 1039.

The laser beam printer 1030 has a cabinet 2001 and the cabinet 2001 incorporates respective mechanisms for forming the engine 1039, the engine controller 1046 for controlling print processes (for example, paper feed, etc.) of each mechanism of the engine, and a control board container 2003 for containing the printer controller 1031 (shown in FIG. 1).

Mechanisms for forming the engine 1039 include an optical process mechanism for forming an electrostatic latent image on a photosensitive drum with an operation of a laser beam, visualizing the electrostatic latent image, and transferring the visual image to a printing paper, a fixing mechanism for fixing a toner image transferred to the printing paper, a paper feed mechanism for the printing paper, and a conveying mechanism for the printing paper.

The optical process mechanism has a laser driver 2006 for driving on or off a laser beam emitted from a semiconductor laser (not shown) according to image data supplied from the printer controller 1031 in a laser scanner 2022 and the laser beam emitted from the semiconductor laser is swung in a scanning direction by a rotary polygon mirror 2007. The laser beam swung in the main scanning direction is reflected and guided to the photosensitive drum 2005 through a reflecting mirror 2008 for an exposure of the photosensitive drum 2005 in the main scanning direction.

At this point, a scanning exposure with a laser beam forms an electrostatic latent image on the photosensitive drum 2005 uniformly charged by a primary charger 2023 and the latent image is visualized to a toner image by toner (in this embodiment, K (black) toner is used for the toner) supplied from a developing unit 2020.

The toner image on the photosensitive drum 2005 is transferred to the printing paper 2027 supplied synchronously in a sub-scanning direction by the paper feed mechanism by using a transfer charger 2025. The photosensitive drum 2005 and the developing unit 2020 are contained in a drum unit 2004 detachably mountable on the cabinet 2001.

The reflecting mirror 2008 is formed by a semitransparent mirror and a beam detector 2009 is arranged on its rear side. The beam detector 2009 detects a laser beam and its detection signal is supplied to the printer controller 1031. The printer controller 1031 generates a horizontal synchronizing signal for determining an exposure timing in the main scanning direction on the basis of the detection signal of the beam detector 2009 and the horizontal synchronizing signal is outputted to the printer controller 1031. A cleaner 2024 removes remaining toner on the photosensitive drum 2005. A front exposure lamp 2021 removes electric charges on the photosensitive drum 2005.

On the other hand, the fixing mechanism is provided with a heater for heating the toner image transferred to the printing paper. The heater is controlled with a temperature adjustment by using a signal from the engine controller 1046 so as to obtain a predetermined fixing temperature (a power lowering control is also performed in a standby condition for printing). The paper feed mechanism for the printing paper is configured so as to selectively supply printing papers in the cassette 2010 and a paper feed tray 2019 containing the printing papers 2027 and printing papers in a converting paper feed unit 2011.

The cassette 2010 is installed inside the cabinet 2001 and the cassette 2010 is provided with the paper sensor 1052 and a size detecting mechanism for electrically detecting a size of the printing paper according to a shaft position of a divider (not shown).

The printing paper in the cassette 2010 is conveyed up to a feeding roller 2013 by rotative driving of a cassette feed clutch 2012 in units of a sheet from the top sheet. The cassette feed clutch 2012 is formed by a cam rotative-driven intermittently by driving means (not shown) for every paper feed and a single printing paper is supplied for every single rotation of the cam.

The feeding roller 2013 conveys the printing paper up to a position where its tip corresponds to a registration shutter 2014 and the registration shutter 2014 stops feeding of the printing paper or releases it by a press of the supplied printing paper or by its release. The operation of the registration shutter 2014 is controlled so as to be synchronized with the sub-scanning of the laser beam. The cassette 2010 has a configuration in which a predetermined number of stacked option cassettes (not shown) can be mounted being classified by a size. A manual feed tray 2019 is arranged in the cabinet 2001 and a printing paper mounted by a user on the manual feed tray 2019 is advanced by the feeding roller 2015 toward the registration shutter 2014.

On the other hand, the printing paper conveying mechanism comprises a conveying roller 2016 for conveying the printing paper released from the press with the registration shutter 2014 toward the photosensitive drum 2005, flappers 2030 and 2031 for guiding the printing paper ejected from the fixing unit 2017 to a paper ejection tray FD formed in an upper portion of the cabinet 2001, conveying rollers 2032 and 2033, and driving means (not shown) for driving the conveying rollers 2032 and 2033. The flapper 2031 enables an exchange of an ejection destination between the paper ejection tray FD formed in the upper portion of the cabinet 2001 and a paper ejection tray FU formed in a side of the cabinet 2001 by switching the flapper; for face-down printing (a surface of a printed document having an earlier page faces down after printing) the paper is ejected to the ejection tray FD, while for face-up printing (a surface of a printed document having an earlier page faces up after printing) the paper is ejected to the ejection tray FU.

In addition, duplex printing is enabled by exchanging the flapper 2030. The converting paper feed unit 2011 has an engine conveying rollers 2034, 2035, and 2036 and a flapper 2037.

For duplex face-down printing (a face surface faces down in the drawing and a reverse surface faces up in the drawing on the ejection tray FD after printing), the printing on a reverse surface of the printing paper 2027 is started first; if the paper is supplied from the cassette 2010 (indicated by an arrow Y1), data is printed on the reverse surface (indicated by an arrow Y2) and then guided to the converting paper feed unit 2011 via the conveying rollers 2038 and 2034 by the flapper 2030 (indicated by arrows Y3 and Y4).

If a sensor which is not shown detects a rear edge of the printing paper 2027, the printing paper 2027 is contained in the converting paper feed unit in parallel to the paper cassette 2010 by the conveying roller 2035 by rotating the conveying roller 2034 in an opposite direction to switch the flapper 2037 (indicated by arrows Y5, Y6, and Y7). At this point, the printed surface of the printing paper (reverse surface) faces up.

Next, if the converting paper feed unit 2011 is specified as a paper feed destination, the paper passes through the transfer charger 2025 and the fixing unit 2017 again via the conveying roller 2036 and the feeding roller 2013 (indicated by an arrow Y8) for printing on the face surface (indicated by an arrow Y9) and then the paper is ejected to the ejection tray FD (indicated by an arrow Y10) by switching the flappers 2030 and 2031.

For duplex face-up printing (a face surface faces down in the drawing and a reverse surface faces up in the drawing on the ejection tray FU after printing), printing on the face surface is performed first and then the paper is ejected to the converting paper feed unit 2011 before printing on the reverse surface and discharging the paper from the converting paper feed unit 2011 to the ejection tray FU (indicated by an arrow Y11).

Figure 3:
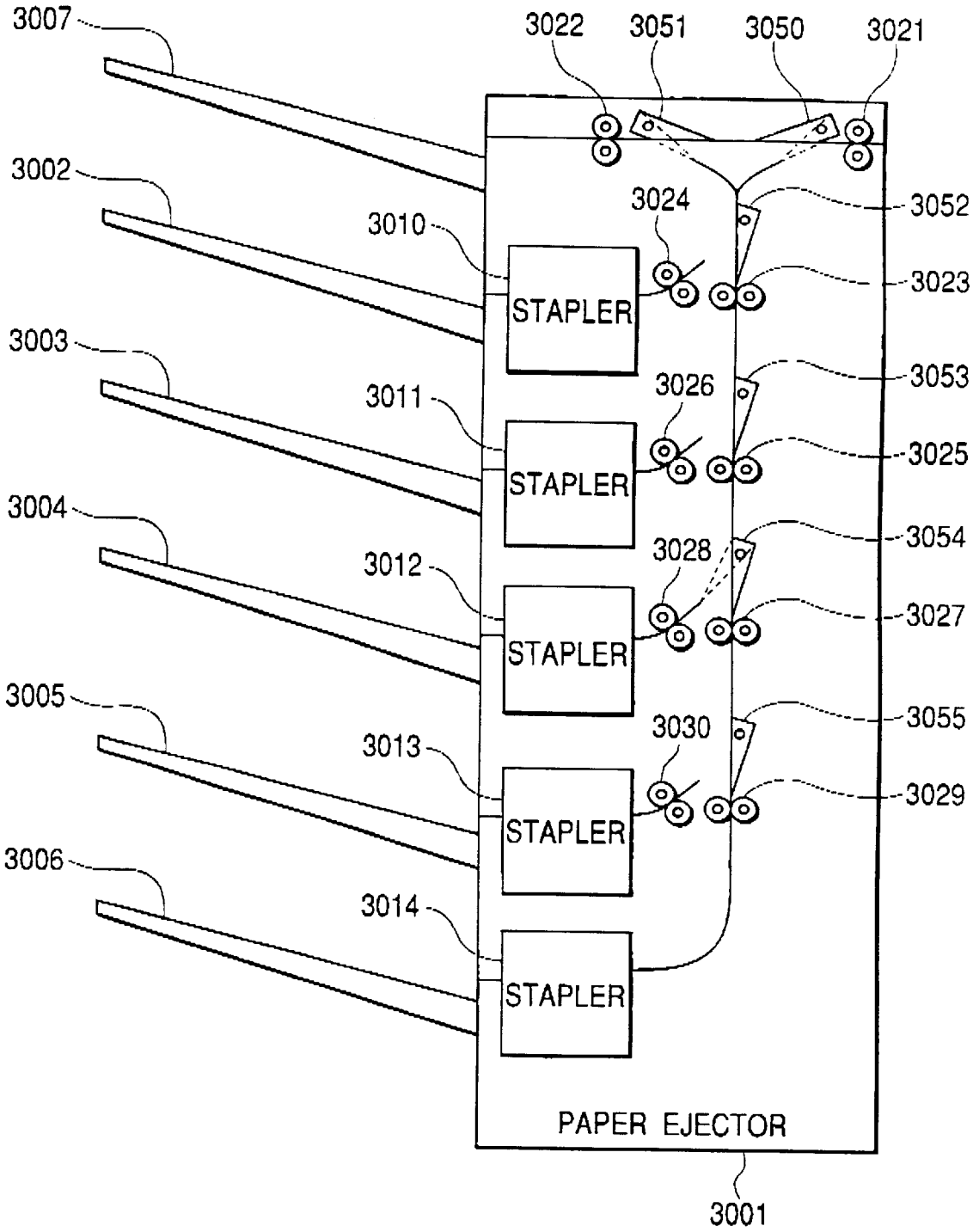
FIG. 3 is a schematic view showing a configuration of a paper ejector connected to a body of the printer.

Referring to FIG. 3, there is shown a schematic diagram illustrating a configuration of the paper ejector connected to the body of the printer having the above configuration.

This paper ejector 3001 is detachably mountable on a portion indicated by FU (FIG. 2) of the cabinet 2001; the paper ejector 3001 has a paper ejector bin (1) 3002 for holding printed paper, a paper ejector bin (2) 3003, a paper ejector bin (3) 3004, a paper ejector bin (4) 3005, a paper ejector bin (5) 3006, and a paper ejector bin (6) 3007 and conveying rollers 3021 to 3030 are used for discharging a paper conveyed from the engine unit to each bin.

Flappers 3050 to 3055 are used for changing a conveying direction of an already printed paper. For example, if the flappers 3050 and 3054 are switched as indicated by dotted lines, the conveyed printed paper is guided to the paper ejector bin (3) in a face-up condition.

The paper ejector bin (6) is used for ejecting special papers such as cardboard or OHT and it is also possible to eject papers to the paper ejector bins (1) to (5) in a face-down condition by transmitting a printing paper to the bin (6). In the latter condition, the flappers 3050 and 3051 are set first as indicated by solid lines and then the paper is conveyed to the paper ejector bin (6) once. Then, the paper is moved backward by rotating the conveying roller 3022 in an opposite direction after the paper passes the flapper 3051, the paper is reversed in its front and rear ends by setting the flapper 3051 as indicated by the dotted lines, and the flapper 3054 is switched as indicated by the dotted lines, thereby achieving face-down printing of the paper. In this manner, controlling the flappers enables face-up or face-down printing to the paper ejector bins (1) to (6).

The paper ejector bins (1) to (6) are provided with staplers 3010, 3001, 3012, 3013, and 3014 capable of stapling on documents ejected to the paper ejector bins. Each of the staplers is configured so as not to affect other ejector bins when the paper is ejected to any of other ejector bins since stapling is directly performed in each ejector bin.

In addition, the cabinet 2001 has an operation panel 2002 attached for forming the panel unit 1041. The operation panel 2002 is provided with a switch group for directing input operations, LED indicators for indicating information, and an LCD display unit. Furthermore, it has an external memory unit 2040 attached for forming the external memory unit 1043 used for storing print data by the printer controller 1031.

Next, an operation of the printer controller 1031 having the above configuration is described below.

In the host computer 1001, if an execution of printing is specified by a specification from a user, a received control code or data is transmitted from the host computer via the communication line 1002 and then passed to the RAM 1036 via the host I/F 1032 and the input buffer 1033 so as to be stored in the RAM 1036.

The CPU 1034 processes the data in the image generator 1037 conforming to a program described in the program ROM 1035 and then generates image information on each image object such as graphic, character, or image data. At this point, the document manager 1060 manages documents transmitted from the host computer 1001 by a document type, recognizes an interrupting document or an interrupted document, and manages their data printing conditions.

Then, the page scheduler 1061 develops image information of all the image objects in a single page to be printed next to a bit map image to be actually printed in the bit map unit 1038, taking into consideration which page should be printed next on the basis of the information of the document manager 1060. The developed bit map image is transmitted to the printer engine 1039 and the printed paper is ejected from the specified ejection port.

For duplex face-down printing, an image on the reverse surface is developed into a bit map image to be actually printed in the bit map image unit 1038, first. The developed bit map image on the reverse surface is transmitted to the printer engine 1039 and ejected to the converting paper feed unit 2011 shown in FIG. 2 after a paper feed from the cassette. Subsequently, an image on the face surface is developed into a bit map image actually printed in the bit map unit 1038, the developed bit map image on the face surface is transmitted to the printer engine 1039, and ejected to the paper election tray FD shown in FIG. 2 after a paper feed from the converting paper feed unit 2011.

The printer applied to the present invention is not limited to a laser beam printer, but naturally a printer of any of other printing methods is applicable.

Hereinafter, a description will be given for an operation of continuing a print process with a user's specification of a substitute paper type in case of running out of an optimum type of papers during printing when the print process is executed.

In this embodiment, in the user's specification of the substitute paper type, the paper selection is controlled so that it is impossible to select the paper types disabling the specified print process to be appropriately continued. For the paper type, two elements of a paper size and a paper type are considered. The paper size represents a paper size referred to as A4, A3, or others. The paper type represents a paper material, including a plain paper, an OHP paper, and an intermediate paper (for second original) which are popularly used. In addition, a reused paper is also included as an example of the paper type in this embodiment. The reused paper has a purpose for eliminating the waste by reusing only one non-printed surface of the paper on which some print has been made once on the other surface and then discarded.

Before printing, it may be specified how the image-printed paper is finished in addition to a specification of what image is printed on the paper. In this description, the specification is treated to be of a finishing type. As concrete examples of the finishing type, fair copy, stapling, punching, and duplex types are assumed.

If a user specifies printing, generally the user specifies the above three elements, namely, a paper size, a paper type, and a finishing type. These three elements are collectively referred to as print mode.

Even if a certain print mode is specified, the specification cannot always be performed. For some reason such as a mechanical limitation of the stapler 3010 or a paper type limitation, the specified finishing process type cannot be executed with the specified paper size or paper type in some cases. When printing is executed or papers are insufficient, executable print modes are checked and then the paper for the printing is selected according to a result of the check.

Therefore, information, which is collected being focused on whether the finishing types are executable on the basis of the paper sizes and the paper types as shown in FIG. 4, is stored in the program ROM 1035 so as to be referenced. In this embodiment, this information is referred to as a print mode table in the description. It is assumed that the print mode table is stored in the program ROM 1035 in the description and therefore its content does not change here. The print mode table, however, need not always exist in the ROM 1035, but can be arranged in the RAM 1036. For example, an executable finishing type of information is affected by a type of the paper ejector 3001 and therefore the user may change the content of the print mode table according the type of the paper ejector 3001 for use, so that the content is stored in the RAM 1036.

Referring to FIG. 4, there is shown a diagram of the content of the print mode table.

The table shows whether respective finishing types are executable for each paper size or paper type. Information on whether a finishing type is executable can be represented by a single bit, and therefore the information is stored with 1 as an executable case and 0 as a nonexecutable case. For example, for the plain paper as the paper type, all the finishing types are executable, while for the intermediate paper, stapling and duplex printing are nonexecutable. In representations with binary numerals, the former is "11111" and the latter is "11010". If the paper type is the plain paper and the paper size is A3, both of the plain paper condition and the A3 condition must be satisfied at a time. Therefore, the plain paper condition "11111" and the A3 condition "11101" are ANDed, thereby obtaining a result "11101", by which it is finally found that punching is nonexecutable.

Next, concrete processes according to this embodiment will be described by using the flowcharts in FIG. 5 to FIG. 8. The following control method can be realized by storing programs conforming to the flowcharts in FIG. 5 to FIG. 8 in the program ROM 1035 or the like in the printer controller 1031 and operating them.

In this example, assuming that there are five cassettes 2010 and each cassette 2010 contains various papers as shown in FIG. 9. When printing is designated with specifying an A4 paper size and a plain paper type, a paper is supplied from the cassette 2010 in the first stage and printing is started. It is assumed here that the paper in the cassette 2010 in the first stage is used up for a subsequent description of the operation.

First, in step S501, it is checked that a page to be printed is the first page of the print job. If it is the first page, the control progresses to step S502. Otherwise, it progresses to step S503.

In the step S502, information on which stage of the cassette 2010 is selected for a paper feed for printing (hereinafter, referred to as "cassette selection information") is cleared and the control progresses to step S504. This information is stored in the RAM 1036 and therefore information can be set or cleared at an arbitrary timing.

In the step S503, the print mode is changed between a previously printed page and the page to be printed now. If it is changed, the control progresses to the step S502. Otherwise, it progresses to the step S504. If the control progresses to the step S502, the cassette selection information is cleared as set forth in the above to determine which stage should be selected for the paper feed anew.

In the step S504, it is confirmed whether the cassette selection information is determined. If it is determined, the control progresses to step S505. Otherwise, it progresses to step S506. A location where this information is stored is the same as one for the information cleared in the step S502, which results in that if the process of the step S502 is executed the control progresses to the step S506 or otherwise the control progresses to the step S505.

Figure 6:
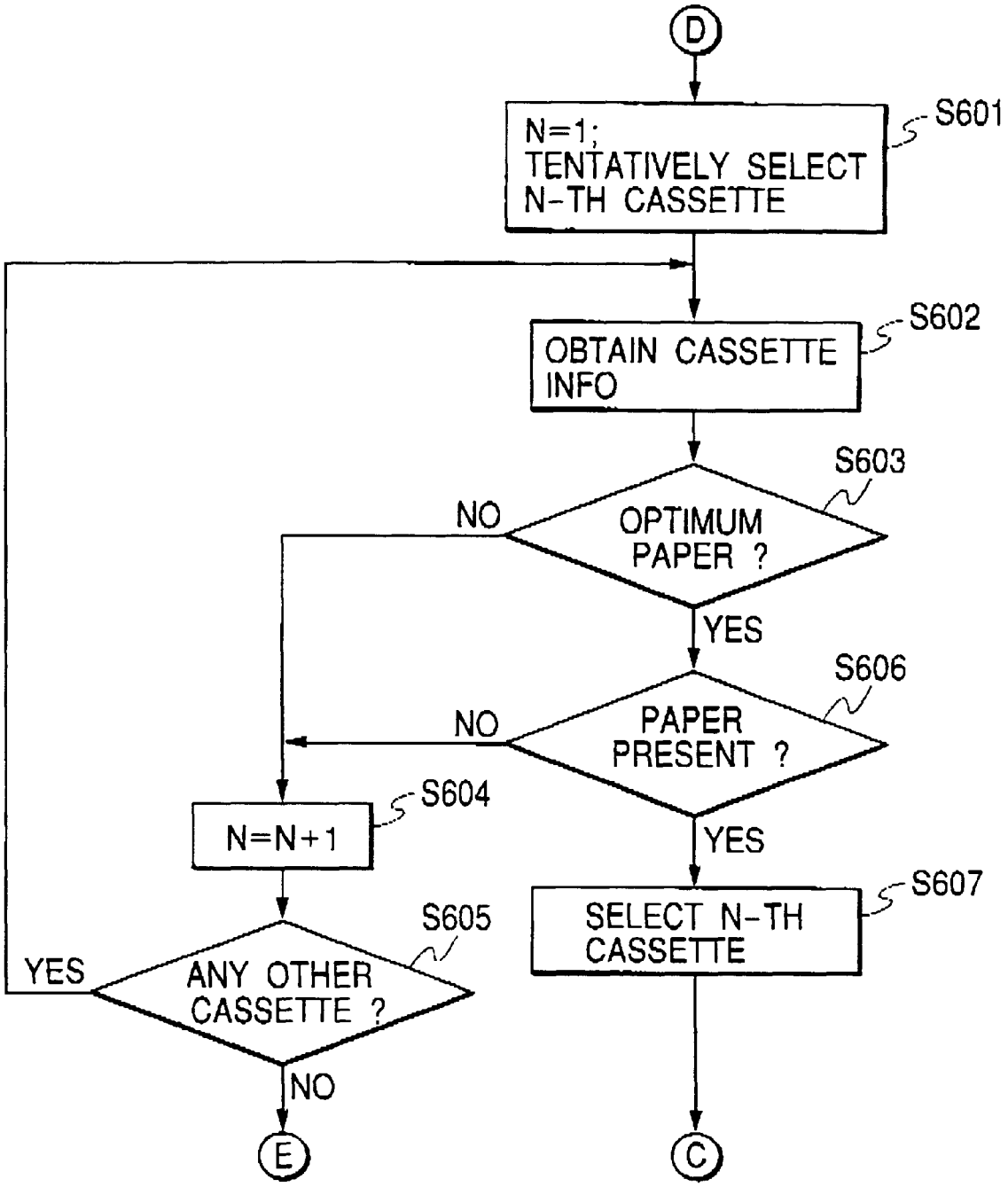
FIG. 6 is a flowchart continued from FIG. 5.
Figure 7:
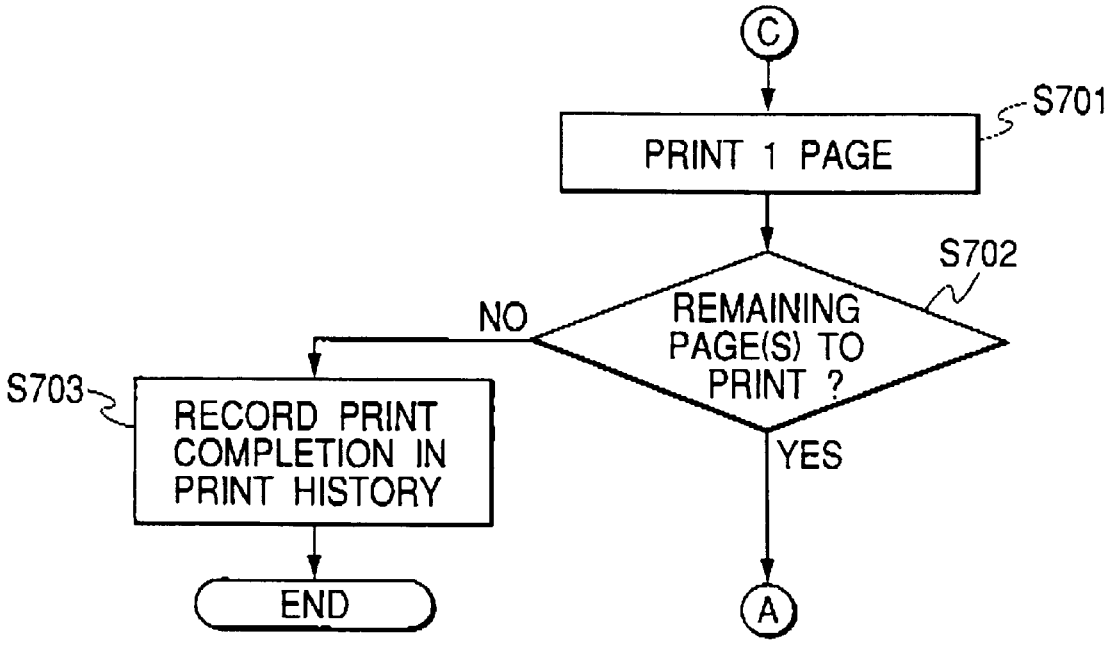
FIG. 7 is a flowchart continued from FIG. 5.

In the step S505, it is checked that there is a paper in the cassette 2010 to be used for the paper feed; if so, the control progresses to step S701 in FIG. 7 via C, otherwise it progresses to step S601 in FIG. 6 via D. If the paper runs out while the cassette 2010 for the paper feed is determined by executing the process of the step S505, another appropriate cassette 2010 can be selected again for the paper feed by executing processes of the step S601 and after.

On the other hand, in the step S506, it is checked that the print mode specified for the page to be printed is executable. If it is executable, the control progresses to the step S601 via D. Otherwise, the control progresses to the step S507. To determine this, refer to information of the print mode table in FIG. 4.

For example, if A4, a plain paper, and stapling are selected as the specified print modes, the A4 numeral "11111" and the plain paper numeral "11111" are ANDed, thereby obtaining "11111" in which the bit indicating stapling is 1, by which it is found that stapling is executable. Therefore, in this case, the control progresses to the step S601. On the other hand, if A4, OHP paper, and stapling are selected as the specified print modes, the A4 numeral "11111" and the OHP paper numeral "11000" are ANDed, thereby obtaining "011000" in which the bit indicating stapling is 0, by which it is found that stapling is nonexecutable. Therefore, in this case, the control progresses to the step S507.

In the step S507, remaining data is deleted since it is found that the printing cannot be continued any more based on the determination in the step S506 and then the control progresses to step S508. In the step S508, the printing is stopped to record the data deletion in a print history and then the process is terminated. This print history can be recorded into the RAM 1036 and deleted at the power off or can be recorded into a nonvolatile memory such as a hard disk or a flash ROM which are not shown and retained after the power off.

With a control as set forth hereinabove, data can be deleted without any wasteful printing if a nonexecutable print mode is specified and further the deletion can be recorded as a print history.

In the step S601 and after shown in FIG. 6, a cassette 2010 is determined for the paper feed for the page to be printed now.

In the step S601, the cassettes 2010 are checked one by one and therefore the first cassette 2010 is selected as an object of the first check and then the control progresses to step S602. In the step S602, information on the cassette 2010 to be checked is acquired and the control progresses to step S603. To acquire the information on the cassette 2010, information shown in FIG. 9 is read out of the RAM 1036 in this description. In addition, this information is referred to as a cassette information table.

The content of the cassette information table is assumed to be rewritten at an appropriate timing in case of a change of a size or a type of the paper in each cassette 2010. Therefore, to confirm what kind of paper is contained in each cassette 2010, the information of this cassette information table should be read. For example, if the cassette 2010 to be checked is in the first stage, information of the A4 plain paper is acquired. It should be noted that, however, the method of checking the type of paper in each cassette 2010 by using the cassette information table is shown only as an exemplification for realizing the present invention, while the present invention is also achievable by using a method of directly inquiring of each cassette 2010 and a method for the check is not a condition for defining the present invention.

In the step S603, information on the paper in the cassette 2010 to be checked acquired in the step S602 is compared with the content of the print mode specified for the page to be printed now to determine whether it is an optimum cassette 2010. Unless it is an optimum cassette 2010, the control progresses to step S604, or otherwise the control progresses to step S606. For example, if A4, plain paper, and stapling are selected as the specified print modes, a paper feed with the A4 plain paper is enabled when the cassette 2010 to be checked is in the first stage and therefore the control progresses to step S606. On the other hand, if the cassette 2010 to be checked is in the second stage, it contains A3 plain papers and therefore the control progresses to the step S604.

In the step S604, a cassette to be checked is advanced to the next one and the control progresses to the step S605. In the step S605, it is checked that the cassette 2010 to be checked actually exists. If it exists, the control returns to the step S602. Otherwise, the control progresses to step S801 shown in FIG. 8 via E. A repetition of the processes from the step S601 to the step S605 enables a detection of a cassette 2010 containing papers optimum for the print mode specified for the page to be printed now. Unless there is any cassette 2010 containing optimum papers, the control progresses to the step S801 via E.

On the other hand, in the step S606, whether a paper remains in the detected cassette 2010 containing the optimum paper is confirmed. If it remains, the control progresses to step S607. Otherwise, it progresses to the step S604. With this control, if no paper remains in the optimum paper cassette 2010 though it is detected, another cassette is further detected.

In the step S607, is written information of the paper feed from the cassette 2010 detected in the step S603 and the control progresses to step S701 via C. An area for writing this information is the same as the area in which the information is cleared in the step S502 or referenced in the step S504 in FIG. 5.

An execution of the process of the step S601 and subsequent ones as set forth hereinabove enables the paper feed from the cassette 2010 containing a paper optimum for printing.

In the step S701 shown in FIG. 7 and after, there is performed a printing operation after the determination of the cassette 2010 for the paper feed.

In the step S701, after the paper feed performed on the basis of the determined cassette selection information, the print process is executed and the control progresses to step S702.

In the step S702, it is checked that there is any remaining page to be printed in the print job currently under the process. If there remains any page, the control returns to the step S503 via A. Otherwise, the control progresses to the step S703.

In the step S703, a normal completion of the print process is recorded in the print history and then the process is terminated.

By executing the above processes repeatedly, all the print data included in the print job can be printed.

Next, processes in step S801 and after shown in FIG. 8 will be described below.

The control progresses to the step S801 when there is no optimum paper for realizing a print mode specified for a page to be printed.

Figures 10A, 10B, 10C:
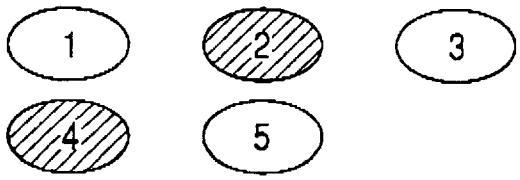
FIGS. 10A, 10B and 10C are diagrams of assistance in explaining an operation of the first embodiment.

In the step S801 a forced selection of the cassette 2010 for the paper feed is displayed on an LCD portion of the operation panel 2002, and then the control progresses to step S802. An example of the displayed message is shown in FIG. 10A. This display enables a user to be notified that there is no paper optimum for the printing and to be forcibly requested to select a substitute paper type.

In the step S802, to confirm whether a paper can be forcibly supplied from each cassette 2010, the cassette 2010 in the first stage is determined to be checked, first, and then the control progresses to step S803.

In the step S803, it is checked that a finishing type in the print mode specified for the page to be printed is executable by using the paper in the cassette 2010 to be checked. If it is executable, the control progresses to step S804. Otherwise, the control progresses to step S805.

In the step S804, the cassette 2010 to be checked is available for the forced cassette selection and therefore it is indicated as an available button in the LCD portion of the operation panel 2002. Then, the control progresses to step S806.

On the other hand, in the step S805, the cassette 2010 to be checked is not available for the forced cassette selection and therefore it is indicated as an unavailable button in the LCD portion of the operation panel 2002. Then, the control progresses to the step S806.

By performing these operations in the steps S803, S804, and S805, it is checked that the cassette 2010 is available for the forced cassette selection according to the type of the paper in the cassette 2010 to be checked and the print mode specified for the page to be printed, and the result can be reflected on the LCD portion of the operation panel 2002 as an indication. For example, it is assumed that stapling is specified as a finishing type among the specified print modes. If the cassette 2010 in the first stage is to be checked, the A4 numeral "11111" and the plain paper numeral "11111" are ANDed, thereby obtaining "11111" in which the bit indicating stapling is set to 1, by which it is found that stapling is executable. As a result, the control progresses to step S804 and the cassette 2010 in the first stage is indicated as available for the forced cassette selection in the LCD portion of the operation panel 2002.

On the other hand, if the cassette 2010 in the fifth stage is to be checked, the A4 numeral "11111" and the intermediate paper numeral "11010" are ANDed, thereby obtaining "11010" in which the bit indicating stapling is set to 0, by which it is found that stapling is nonexecutable. As a result, the control progresses to step S805 and the cassette 2010 in the fifth stage is indicated in the LCD portion of the operation panel 2002 as unavailable for the forced cassette selection.

Subsequently, in the step S806, a cassette 2010 to be checked is advanced to the next one. Then, the control progresses to step S807. In the step S807, whether the cassette 2010 to be checked actually exists is confirmed. If it exists, the control returns to the step S803. Otherwise, the control progresses to step S808.

By repeating processes from the step S803 to the step S807, all the cassettes 2010 can be checked to confirm whether they are available or not for the forced cassette selection. For example, it is assumed that A4, plain paper, and punching are specified as the print modes for a page intended for printing. Although normally printing is executed by supplying a paper from the cassette 2010 in the first stage, another cassette 2010 containing the optimum paper is searched for if the paper in the cassette 2010 in the first stage runs out. In this embodiment, however, no optimum paper is contained in the cassettes in the stages other than the first one, and therefore the processes from the step S801 should be performed.

Therefore, the size and type numeral values of the paper in each cassette are ANDed to determine whether the punching is executable with the paper in each cassette. A calculation result for the determination is shown in a table in FIG. 10B. According to this table, the cassettes 2010 in the first, third, and fifth stages are determined to be available for the forced cassette selection and finally information as shown in FIG. 10C is displayed in the LCD portion of the operation panel 2002. In this display, the buttons indicating the cassettes 2010 in the second and fourth stages are weakly displayed and the screen is controlled so that any depression is ignored even if these buttons are depressed. This enables a selection of the cassettes 2010 in the first, third, and fifth stages and disables a selection of the cassettes in the second and fourth stages.

Figure 5:
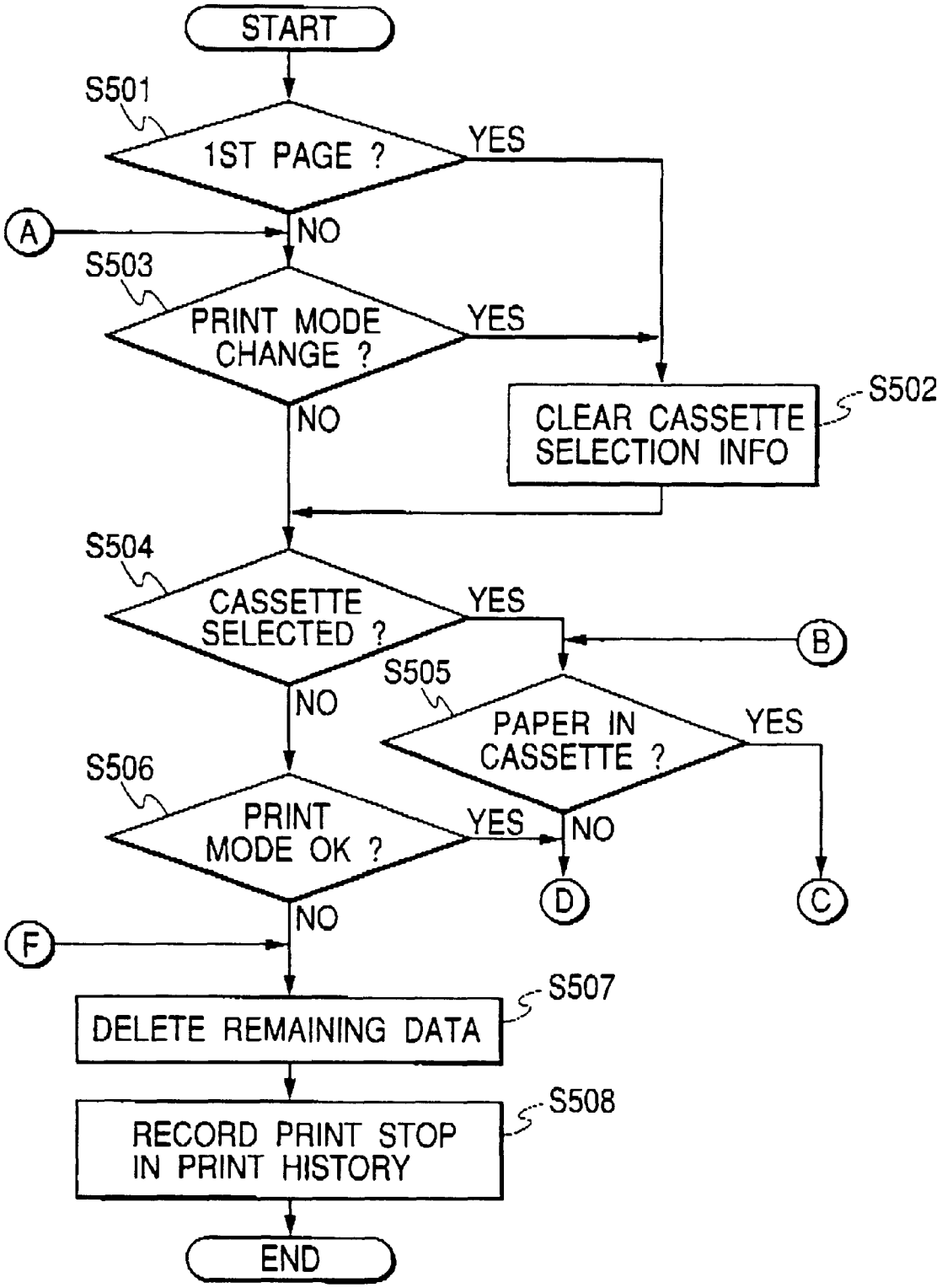
FIG. 5 is a flowchart showing a process of the first embodiment.

In the step S808, a specification of the forced cassette selection of the cassette 2010 from the user is awaited and the specification is directly stored as a cassette 2010 for the paper feed and the control progresses to the step S505 in FIG. 5 via B. In this case, the window shown in FIG. 10C is displayed in the LCD portion of the operation panel 2002 and therefore the user can select one of the cassettes 2010 in the first, third, and fifth stages.

As set forth hereinabove, an execution of the processes from the step S801 to the step S808 enables a user to select a cassette 2010 containing a paper available for the specified finishing type so as to continue the print process even if there is no cassette 2010 containing the optimum paper. Furthermore, by supplying the cassette 2010 in the first stage with A4 plain papers anew, the user can achieve a complete printing result as he or she intended by using the optimum paper to continue the printing.

In addition, an execution of the processes shown in FIG. 5 to FIG. 8 enables the user to select a cassette 2010 containing appropriate papers in accordance with a presence or absence of the paper or with a change of the print mode to continue the printing.

Second Embodiment

In the first embodiment in the above, there has been described about an example in which only a single finishing type of the print mode is specified. In this embodiment, an operation is described by giving an example that a plurality of finishing types are specified at a time.

If a plurality of finishing types of the print mode are specified at a time, the print process can be executed as a whole only if all the specified finishing types are executable. For example, if the content of the cassette information table is as shown in FIG. 9 and punching and fair copy are specified at a time, conditions are determined as shown in a table in FIG. 11A. In other words, each cassette 2010 is checked to confirm whether punching and fair copy is executable; if it is executable it is set to 1 or otherwise it is set to 0. This causes such a determination that punching and fair copy can be executed at a time only for the cassettes having both of punching and fair copy set to 1. According to the table in FIG. 11A, apparently punching and fair copy can be executed at a time only for the cassettes in the first and fifth stages.

Figure 8:
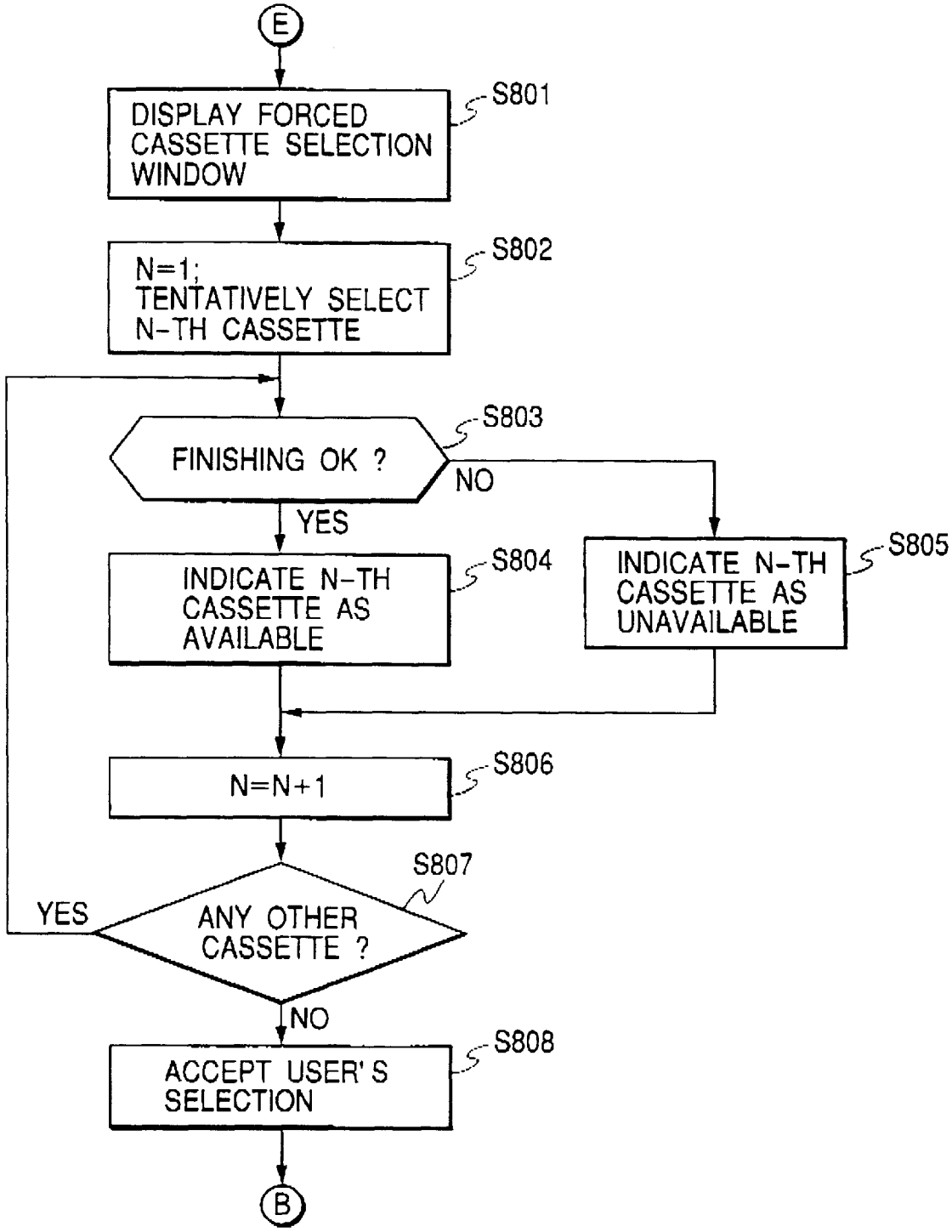
FIG. 8 is a flowchart continued from FIG. 6.
Figures 11A, 11B:
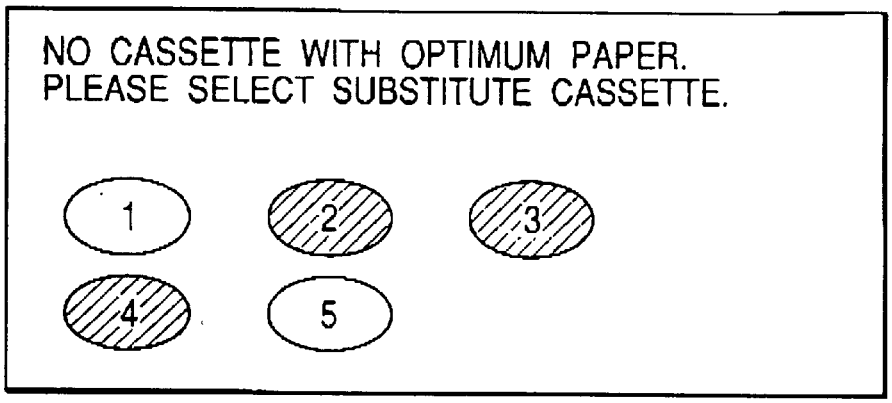
FIGS. 11A and 11B are diagrams of assistance in explaining an operation of a second embodiment.

This determination is executed in the step S506 in FIG. 5 and the step S803 in FIG. 8. For example, if the condition is as shown in FIG. 11A in the step S803, information shown in FIG. 11B is displayed in the LCD portion of the operation panel 2002. In this condition, the user can select one of the cassettes in the first stage and the fifth stage.

As set forth hereinabove, the present invention is also applicable to a case in which a plurality of finishing types are specified concurrently. While the description is given for a case in which two finishing types are concurrently specified in this embodiment, the present invention is applicable to a case in which three or more finishing types are concurrently specified and the number of the finishing types is not limited.

Third Embodiment

In the above first embodiment, the forced cassette selection in the process described in the flowchart in FIG. 8 is controlled so as to inhibit a selection of the cassettes containing papers unavailable for the specified finishing types. On the contrary, in this embodiment, there is described an operation in which available cassettes include the cassettes containing papers unavailable for the specified finishing types.

Figure 12:
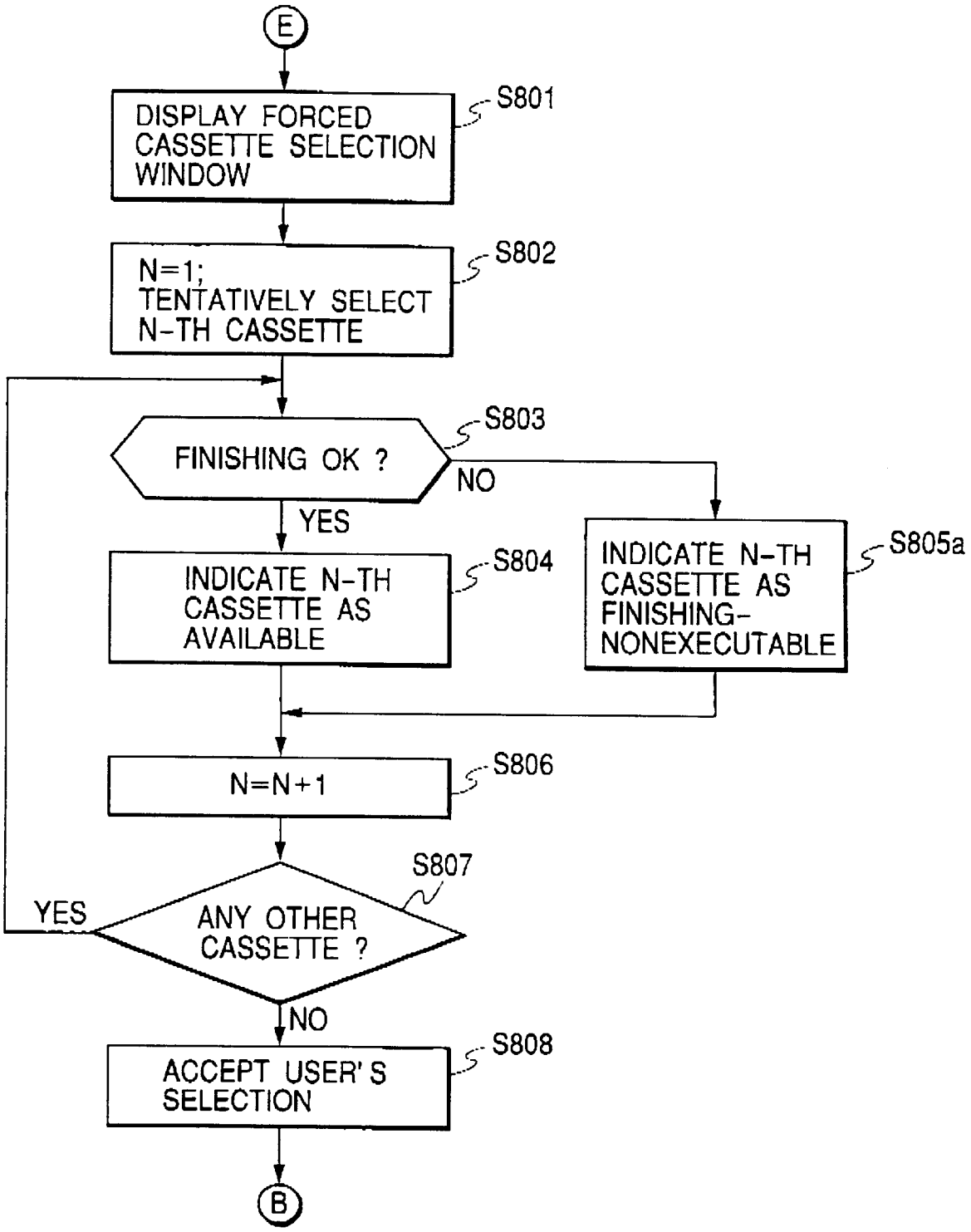
FIG. 12 is a flowchart of a process according to a third embodiment.

A flow of the entire process is almost the same as for the above each embodiment and therefore operations in flowcharts as shown in FIG. 5, FIG. 6, FIG. 7, and FIG. 12 are executed by referring to various tables shown in FIG. 4 and FIG. 9. This embodiment differs from the first embodiment only in a single process, which is a process of step 805*a* in the flowchart in FIG. 12 shown instead of FIG. 8. In the above first embodiment, the cassettes nonexecutable for the specified finishing type are displayed as unavailable buttons in the display in the LCD portion of the operation panel 2002 in the step S805. On the other hand, in this embodiment, they are displayed as available buttons in the step S805*a* shown in FIG. 12 and if the paper in the cassette 2010 is selected on the display a mark indicating that the specified finishing type is nonexecutable is displayed with the button.

Figure 13:
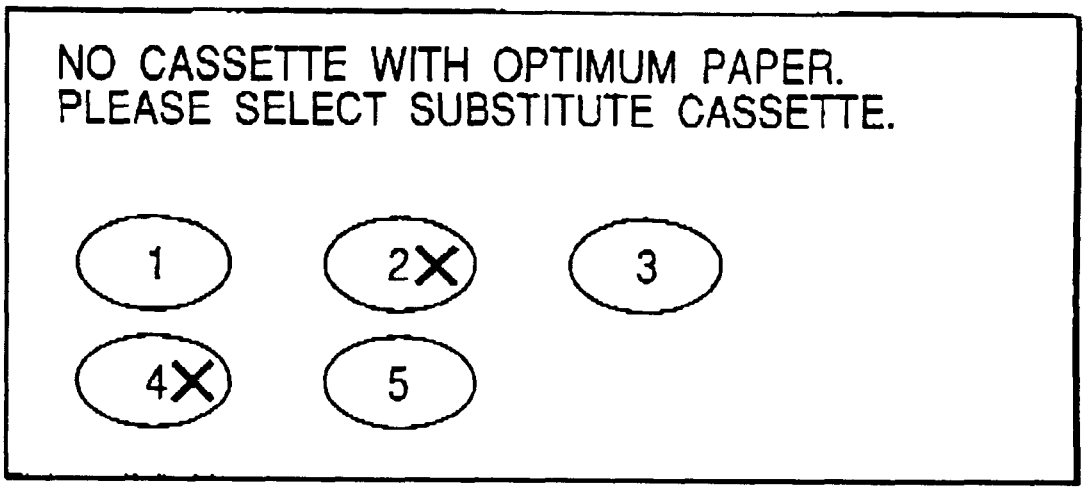
FIG. 13 is a diagram of assistance in explaining an operation of the third embodiment.

Referring to FIG. 13, there is shown a sample display for a case in which punching is specified as a finishing type.

Punching is nonexecutable when using the A3 plain paper in the cassette in the second stage and the A4 OHP paper in the cassette in the fourth stage and therefore the second and fourth stage cassettes 2010 are marked x on the screen shown in FIG. 13. This mark enables a user to recognize that punching is not executed when the paper feed from these cassettes is specified.

As set forth hereinabove, according to the present invention, it becomes possible to leave a determination to a user whether to execute the specified finishing process to continue the printing or to ignore it to continue the printing.

Fourth Embodiment

In the above embodiments, the operation is controlled to necessarily select a cassette for the paper feed to continue the printing in the process described by using the flowchart in FIG. 8. In this embodiment, there is described an operation enabling a user to have another option to stop printing halfway unless the optimum paper exists.

The entire process flow is almost the same as for the first embodiment and the operations in the flowcharts shown in FIG. 5, FIG. 6, FIG. 7, and FIG. 14 are executed by referring to the tables in FIG. 4 and FIG. 9.

Figure 14:
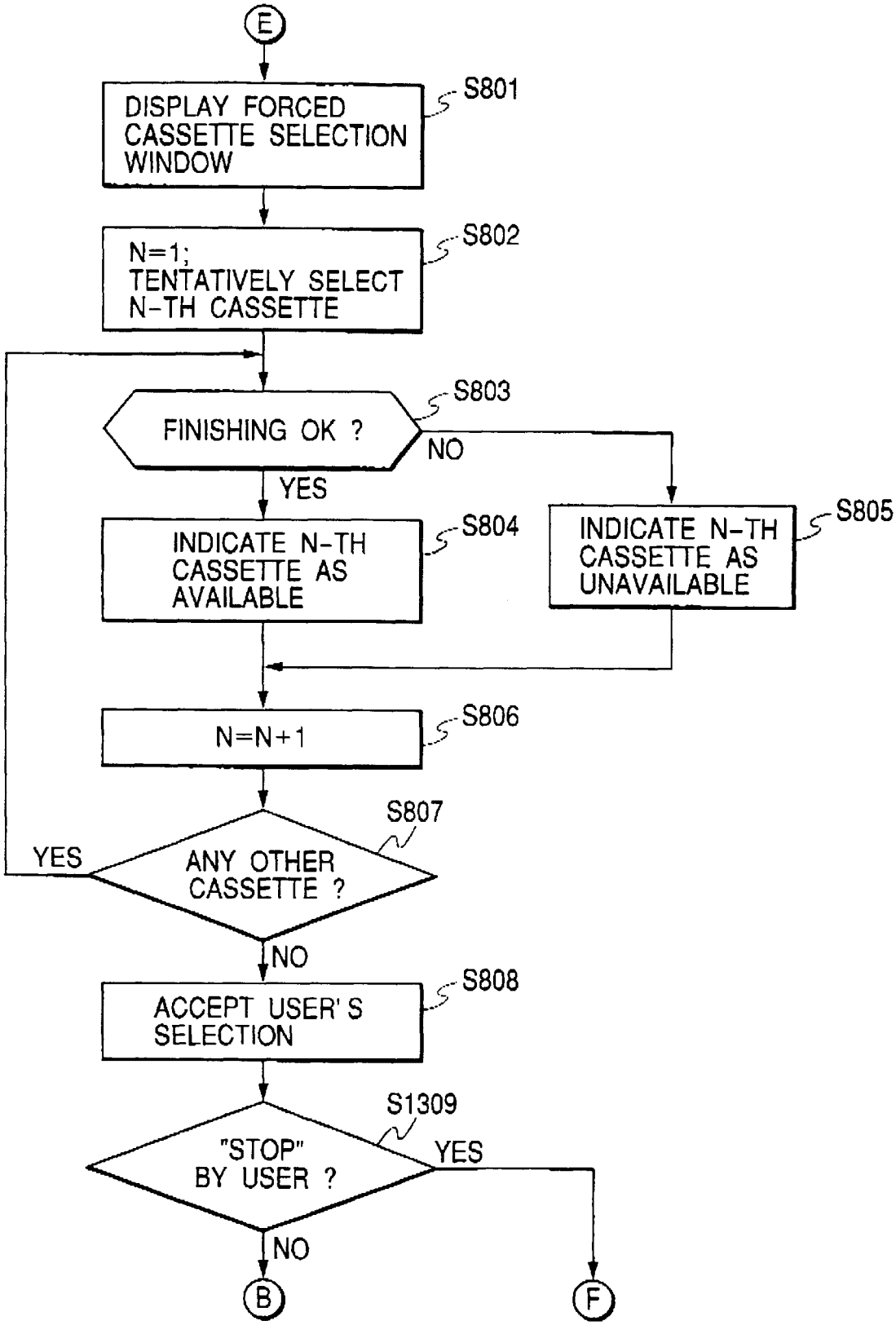
FIG. 14 is a flowchart of a process of the fourth embodiment.

This embodiment differs from the first embodiment in that the process of the flowchart in FIG. 14 is performed instead of the process in FIG. 8. The process of the flowchart in FIG. 14 is almost the same as for FIG. 8 and therefore only the different parts will be described below.

Figure 15:
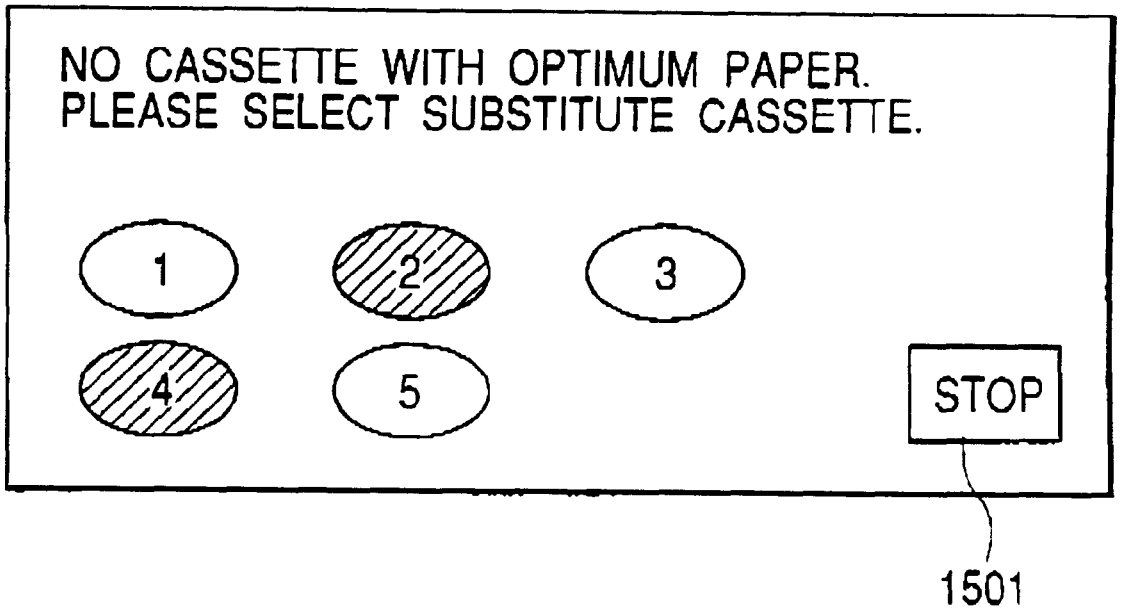
FIG. 15 is a diagram for assistance in explaining an operation of a fifth embodiment.

While processes quite the same as those in the steps S801 to S808 are executed, the window displayed in the LCD portion of the operation panel 2002 is provided with a button 1501 capable of indicating "stop" as shown in FIG. 15.

In the step S1309, checking a content of the user's selection specified in the step S808, the control progresses to the step S507 in FIG. 5 via F if the user selects the "stop" or progresses to the step S505 via B if the user selects one of the cassettes without selecting the "stop". This enables the user to specify the stop operation of printing instead of continuing the printing by forcibly selecting the cassette 2010.

As set forth hereinabove, according to this embodiment, printing can be stopped by an operation control instead of forcibly continuing the printing by using another type of paper unless there is the optimum paper for the printing continuation.

The present invention is not limited to the apparatus according to the above embodiments, but it is applicable to a system comprising a plurality of devices or to an apparatus comprising a single device. Apparently, the present invention can be completed by supplying a storage medium storing a program code of software realizing the functions of the above embodiments to a system or an apparatus and by reading and executing the program code stored in the storage medium by a computer (or a CPU or an MPU) of the system or the apparatus.

In this case, the program code read from the storage medium realizes the functions of the embodiments and the storage medium storing the program code comprises the present invention. As a storage medium for supplying the program code, there can be used, for example, a floppy disk, a hard disk, an optical disk, an optical magnetic disk, a CD-ROM, a CD-R, a magnetic tape, a nonvolatile memory card, and a ROM. In addition, naturally the present invention is applicable to a case that the functions of the above embodiments are realized by executing a part of or the entire actual processes with an operating system running on the computer on the basis of a specification of the program code read from the computer, as well as by executing the program code.

Furthermore, naturally the invention is applicable to a case that the functions of the above embodiments are realized by writing the program code read from the storage medium into a feature expansion board inserted into the computer or into a memory in a feature expansion unit connected to the computer and then executing a part of or the entire actual processes with a CPU in the feature expansion board or the feature expansion unit on the basis of a specification of a subsequent program code.

What is claimed is:

1. A print controller for controlling a printing unit having a plurality of paper cassettes and capable of printing with a predetermined process on a recording medium, comprising:

judgement means for judging a print mode specified by print data from an external apparatus;

recording medium type storing means for storing what type of recording medium is mounted on each of the paper cassettes;

paper cassette selecting means for causing a user to select a substitute paper cassette when detecting that the recording medium in the current paper cassette runs out in printing the print data;

process executable/nonexecutable determination means for determining whether the predetermined process is executable on the recording medium mounted on each of the paper cassettes on the basis of the information obtained from said recording medium type storing means and the print mode judged by said judgement means; and control means for causing, with said paper cassette selecting means, a user to select only the paper cassette having a recording medium on which the predetermined process is determined to be executable by said process executable/nonexecutable determination means.

2. The controller according to claim 1, wherein a size of a recording medium is used as a recording medium type stored in said recording medium type storing means.

3. The controller according to claim 1, wherein a quality of a recording medium is used as a recording medium type stored in said recording medium type storing means.

4. The controller according to claim 1, wherein stapling and/or punching and/or duplex print processes are included in the print modes judged by said judgement means.

5. A print controller for controlling a printing unit having a plurality of paper cassettes and capable of printing with a predetermined process on a recording medium, comprising:

judgement means for judging a print mode specified by print data from an external apparatus;

recording medium type storing means for storing what type of recording medium is mounted on each of the paper cassettes;

paper cassette selecting means for displaying substitute paper cassettes to cause a user to select one of the displayed paper cassettes when detecting that the recording medium in the current paper cassette runs out;

process executable/nonexecutable determination means for determining whether the predetermined process is executable on the recording medium mounted on each of the paper cassettes on the basis of the information obtained from said recording medium type storing means and the print mode judged by said judgement means; and display control means for displaying paper cassettes having a recording medium on which the predetermined process is determined to be executable or nonexecutable by said process executable/nonexecutable determination means so as to be discriminated from each other on said paper cassette selecting means.

6. The controller according to claim 5, wherein a size of a recording medium is used as a recording medium type stored in said recording medium type storing means.

7. The controller according to claim 5, wherein a quality of a recording medium is used as a recording medium type stored in said recording medium type storing means.

8. The controller according to claim 5, wherein stapling and/or punching and/or duplex print processes are included in the print modes judged by said judgement means.

9. A print control method for controlling a printing unit having a plurality of paper cassettes and capable of printing with a predetermined process on a recording medium, comprising:

a judgement step of judging a print mode specified by print data from an external apparatus;

a paper cassette selecting step of causing a user to select a substitute paper cassette when detecting that the recording medium in the current paper cassette runs out in printing the print data;

a process executable/nonexecutable determination step of determining whether the predetermined process is executable on the recording medium mounted on each of the paper cassettes on the basis of the information read from a recording medium type storing unit containing information on what type of recording medium is mounted on each of the paper cassettes and the print mode judged in said judgement step; and a control step of causing, in said paper cassette selecting step, a user to select only the paper cassette having a recording medium on which the predetermined process is determined to be executable in said process executable/nonexecutable determination step.

10. The method according to claim 9, wherein a size of a recording medium is used as a recording medium type stored in the recording medium type storing unit.

11. The method according to claim 9, wherein a quality of a recording medium is used as a recording medium type read from the recording medium type storing unit.

12. The method according to claim 9, wherein stapling and/or punching and/or duplex print processes are included in the print modes judged in said judgement step.

13. A print control method for controlling a printing unit having a plurality of paper cassettes and capable of printing with a predetermined process on a recording medium, comprising:

a judgement step of judging a print mode specified by print data from an external apparatus;

a paper cassette selecting step of displaying substitute paper cassettes to cause a user to select one of the displayed paper cassettes when detecting that the recording medium in the current paper cassette runs out;

a process executable/nonexecutable determination step of determining whether the predetermined process is executable on the recording medium mounted on each of the paper cassettes on the basis of the information read from a recording medium type storing unit containing information on what type of recording medium is mounted on each of the paper cassettes and the print mode judged in said judgement step; and a display control step of displaying paper cassettes having a recording medium on which the predetermined process is determined to be executable or nonexecutable in said process executable/nonexecutable determination step so as to be discriminated from each other in said paper cassette selecting step.

14. The method according to claim 13, wherein a size of a recording medium is used as a recording medium type read from the recording medium type storing unit.

15. The method according to claim 13, wherein a quality of a recording medium is used as a recording medium type stored in the recording medium type storing unit.

16. The method according to claim 13, wherein stapling and/or punching and/or duplex print processes are included in the print modes judged in said judgement step.

17. A printing apparatus having a plurality of paper cassettes and capable of printing with a predetermined process on a recording medium, comprising:

judgement means for judging a print mode specified by print data from an external apparatus;

recording medium type storing means for storing what type of recording medium is mounted on each of the paper cassettes;

paper cassette selecting means for causing a user to select a substitute paper cassette when detecting that the recording medium in the current paper cassette runs out in printing the print data;

process executable/nonexecutable determination means for determining whether the predetermined process is executable on the recording medium mounted on each of the paper cassettes on the basis of the information obtained from said recording medium type storing means and the print mode judged by said judgement means; and control means for causing, with said paper cassette selecting means, a user to select only the paper cassette having the recording medium on which the predetermined process is determined to be executable by said process executable/nonexecutable determination means.

18. A computer program executed in a computer of a print controller for controlling a printing unit having a plurality of paper cassettes and capable of printing with a predetermined process on a recording medium, comprising:

a judgement step of judging a print mode specified by print data from an external apparatus;

a paper cassette selecting step of causing a user to select a substitute paper cassette when detecting that the recording medium in the current paper cassette runs out in printing the print data;

a process executable/nonexecutable determination step of determining whether the predetermined process is executable on the recording medium mounted on each of the paper cassettes on the basis of the information read from a recording medium type storing unit containing information on what type of recording medium is mounted on each of the paper cassettes and the print mode judged in said judgement step; and a control step of causing, in said paper cassette selecting step, a user to select only the paper cassette having a recording medium on which the predetermined process is determined to be executable in said process executable/nonexecutable determination step.

19. A computer-readable storage medium storing the computer program according to claim 18.

20. A computer program executed in a computer of a print controller for controlling a printing unit having a plurality of paper cassettes and capable of printing with a predetermined process on a recording medium, comprising:

a judgement step of judging a print mode specified by print data from an external apparatus;

a paper cassette selecting step of displaying substitute paper cassettes to cause a user to select one of the displayed paper cassettes when detecting that the recording medium in the current paper cassette runs out;

a process executable/nonexecutable determination step of determining whether the predetermined process is executable on the recording medium mounted on each of the paper cassettes on the basis of the information read from a recording medium type storing unit containing information on what type of recording medium is mounted on each of the paper cassettes and the print mode judged in said judgement step; and a display control step of displaying paper cassettes having a recording medium on which the predetermined process is determined to be executable or nonexecutable in said process executable/nonexecutable determination step so as to be discriminated from each other in said paper cassette selecting step.

21. A computer-readable storage medium storing the computer program according to claim 20.

22. A printing apparatus for executing printing with a plurality of paper cassettes, said apparatus comprising:

a determination unit, adapted for determining for each of the plurality of paper cassettes whether a designated print process is executable on a paper type of a recording paper mounted on the paper cassette; and a display control unit, adapted for controlling a display such that (i) one or more of the plurality of paper cassettes for which said determination unit determines that the designated print process is executable and (ii) the rest of the paper cassettes, are displayed distinguishably from each other.

23. An apparatus according to claim 22, wherein said determination unit makes a determination in the event that one of the plurality of paper cassettes is set for an optimum paper type but does not have recording paper of the optimum paper type remaining.

24. An apparatus according to claim 22, wherein said determination unit makes a determination in the event that none of the plurality of paper cassettes is set for an optimum paper type.

25. An apparatus according to claim 22, further comprising a print unit, adapted for printing on a recording paper fed from one of the plurality of paper cassettes for which said determination unit determines that the designated print process is executable.

26. A method of selecting one of a plurality of paper cassettes, comprising:

a determination step of determining for each of the plurality of paper cassettes whether a designated print process is executable on a paper type of a recording paper mounted on the paper cassette; and a display control step of controlling a display such that (i) one or more of the plurality of paper cassettes for which it is determined in said determination step that the designated print process is executable and (ii) the rest of the paper cassettes, are displayed distinguishably from each other.

27. A method according to claim 26, wherein said determination step makes a determination in the event that one of the plurality of paper cassettes is set for an optimum paper type but does not have recording paper of the optimum paper type remaining.

28. A method according to claim 26, wherein said determination step makes a determination in the event that none of the plurality of paper cassettes is set for an optimum paper type.

29. A computer program for causing a computer to execute a selection of one of a plurality of paper cassettes, said program comprising:

a determination step of determining for each of the plurality of paper cassettes whether a designated print process is executable on a paper type of a recording paper mounted on the paper cassette; and a display control step of controlling a display such that (i) one or more of the plurality of paper cassettes for which it is determined in said determination step that the designated print process is executable and (ii) the rest of the paper cassette, are displayed distinguishably from each other.

30. A program according to claim 29, wherein said determination step makes a determination in the event that one of the plurality of paper cassettes is set for an optimum paper type but has no remaining recording paper of the optimum paper type.

31. A program according to claim 29, wherein said determination step makes a determination in the event that one of the plurality of paper cassettes is set for an optimum paper type.

32. A print control method of controlling a printing unit having a plurality of paper cassettes and capable of printing with a predetermined process on a recording medium, comprising:

a judgment step of judging a print mode specified by print data from an external apparatus;

a paper cassette selecting step of causing a user to select a substitute paper cassette when detecting that the recording medium in the current paper cassette runs out in printing the print data;

a process executable/nonexecutable determination step of determining whether the predetermined process is executable on the recording medium mounted on each of the paper cassettes on the basis of the information read from a recording medium type storing unit containing information on what type of recording-medium is mounted on each of the paper cassettes and the print mode judged in said judgment step; and a control step of causing, in said paper cassette selecting step, a user to select only the paper cassette having a recording medium on which the predetermined process is determined to be executable in said process executable/nonexecutable determination step.

* * * * *

UNITED STATES PATENT AND TRADEMARK OFFICE

CERTIFICATE OF CORRECTION

PATENT NO. : 6,606,466 B2
DATED : August 12, 2003
INVENTOR(S) : Nobuhiko Sato

It is certified that error appears in the above-identified patent and that said Letters Patent is hereby corrected as shown below:

Column 1,
Line 48, “aspect,” should read -- aspect of --;
Line 49, “comprising” should read -- a printer comprises --; and
Line 67, “comprising” should read -- comprises --.

Column 2,
Line 7, “runs” should be deleted; and
Line 66, “function” should read -- functional --.

Column 3,
Line 11, “operations” should read -- operation --.

Column 4,
Line 35, “On the other hand,” should read -- Additionally, --.

Column 5,
Line 5, “On the other hand,” should read -- Additionally, --; and
Line 24, “has an” should read -- has --.

Column 6,
Line 26, “3001,” should read -- 3011, --.

Column 7,
Line 10, “but naturally” should read -- and --; and
Line 50, “being focused” should read -- by focusing --.

Column 8,
Line 46, “in the above” should read -- above --.

Column 10,
Line 25, “is written” should be deleted;
Line 26, “S603” should read -- S603 is written --;
Line 38, “feed” should read -- feed is --;
Line 42, “checked that” should read -- checked if --;
Line 62, “to be forcibly” should read -- forces the user to request --; and
Line 63, “requested” should be deleted.

UNITED STATES PATENT AND TRADEMARK OFFICE

CERTIFICATE OF CORRECTION

PATENT NO. : 6,606,466 B2
DATED : August 12, 2003
INVENTOR(S) : Nobuhiko Sato

It is certified that error appears in the above-identified patent and that said Letters Patent is hereby corrected as shown below:

Column 11,
Line 1, "determined to be" should be deleted.

Column 12,
Line 35, "embodiment in the" should read -- embodiment --;
Line 36, "about" should be deleted;
Line 47, "is" should read -- are --; and
Line 48, "it is executable" should read -- executable, --.

Column 13,
Line 10, "as for the" should read -- as for --;
Line 11, "above each embodiment" should read -- each embodiment above --; and
Line 59, "checking" should read -- after checking --.

Signed and Sealed this

Sixteenth Day of December, 2003

JAMES E. ROGAN
*Director of the United States Patent and Trademark Office*